US009815167B2

(12) United States Patent
Hiraki et al.

(10) Patent No.: US 9,815,167 B2
(45) Date of Patent: Nov. 14, 2017

(54) LENS MANUFACTURING METHOD

(71) Applicant: FUJIFILM Corporation, Tokyo (JP)

(72) Inventors: Yasuhito Hiraki, Saitama (JP); Kenji Ito, Saitama (JP); Seiichi Watanabe, Saitama (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/456,035

(22) Filed: Mar. 10, 2017

(65) Prior Publication Data

US 2017/0182621 A1 Jun. 29, 2017

Related U.S. Application Data

(63) Continuation of application No. PCT/JP2015/070567, filed on Jul. 17, 2015.

(30) Foreign Application Priority Data

Sep. 30, 2014 (JP) ..... 2014-202531

(51) Int. Cl.
*B24B 13/01* (2006.01)
*B24B 41/06* (2012.01)
(Continued)

(52) U.S. Cl.
CPC ..... *B24B 13/01* (2013.01); *B24B 13/005* (2013.01); *B24B 41/06* (2013.01); *B24B 49/04* (2013.01); *B24B 49/06* (2013.01)

(58) Field of Classification Search
CPC ..... B24B 7/241; B24B 13/005; B24B 13/01; B24B 41/06; B24B 49/02; B24B 49/04; B24B 49/06
See application file for complete search history.

(56) References Cited

U.S. PATENT DOCUMENTS 7,144,305 B2 * 12/2006 Toyoshima ..... B24B 13/005 451/44
7,500,903 B2 * 3/2009 Toyoshima ..... B24B 13/005 451/384
(Continued)

FOREIGN PATENT DOCUMENTS

JP 4-92760 U 8/1992
JP 8-323571 A 12/1996
(Continued)

OTHER PUBLICATIONS

International Preliminary Report on Patentability for PCT/JP2015/070567 (PCT/IPEA/409) dated Feb. 18, 2016.
(Continued)

*Primary Examiner* — Timothy V Eley
(74) *Attorney, Agent, or Firm* — Birch, Stewart, Kolasch & Birch, LLP

(57) ABSTRACT

A lens manufacturing method including a holding step of holding a lens in a lens holding fixture, and a machining step of machining a surface to be machined in the held lens. A reverse surface of the surface to be machined is machined into a non-planar shape with a first surface shape error. A lens holding surface of the lens holding fixture is machined into the same shape as the non-planar shape with a second surface shape error smaller than the first surface shape error. In the holding step, the reverse surface is brought into surface contact with the holding surface in imitation of the holding surface to correct the shape of the lens such that the reverse surface runs along the holding surface. In the machining step, the surface to be machined is machined in a state where the correction has been made by the holding step.

8 Claims, 13 Drawing Sheets

(51) Int. Cl.

| | |
|---|---|
| ***B24B 49/04*** | (2006.01) |
| ***B24B 49/06*** | (2006.01) |
| ***B24B 13/005*** | (2006.01) |

(56) References Cited

U.S. PATENT DOCUMENTS

| | | | | |
|---|---|---|---|---|
| 2010/0252941 | A1* | 10/2010 | Fujii | B24B 13/06 264/1.24 |
| 2012/0224140 | A1 | 9/2012 | Felten et al. | |

FOREIGN PATENT DOCUMENTS

| | | | |
|---|---|---|---|
| JP | 2000-79547 | A | 3/2000 |
| JP | 2002-126960 | A | 5/2002 |
| JP | 2003-334748 | A | 11/2003 |
| JP | 2005-118979 | A | 5/2005 |
| JP | 2010-137316 | A | 6/2010 |
| JP | 2013-180372 | A | 9/2013 |
| JP | 2013-180373 | A | 9/2013 |

OTHER PUBLICATIONS

International Search Report for PCT/JP2015/070567 (PCT/ISA/210) dated Sep. 15, 2015.
Written Opinion of the International Searching Authority for PCT/JP2015/070567 (PCT/ISA/237) dated Sep. 15, 2015.
Japanese Notification of Reasons for Refusal dated May 16, 2017, for Japanese Application No. 2016-551608, with an English translation.

* cited by examiner

FIG. 9

| | REVERSE SURFACE ASTIGMATISM ERROR | HOLDING FIXTURE SURFACE ERROR | TRANSMISSION WAVE SURFACE ABERRATION |
|---|---|---|---|
| EXAMPLE | 150nm | 30nm | 25nm |
| COMPARATIVE EXAMPLE 1 | 50nm | 200nm | 190nm |
| COMPARATIVE EXAMPLE 2 | 180nm | 30nm | 140nm |

LENS MANUFACTURING METHOD

CROSS-REFERENCE TO RELATED APPLICATIONS

The present application is a Continuation of PCT International Application No. PCT/JP2015/070567 filed on Jul. 17, 2015 claiming priority under 35 U.S.C §119(a) to Japanese Patent Application No. 2014-202531 filed on Sep. 30, 2014. Each of the above applications is hereby expressly incorporated by reference, in their entirety, into the present application.

BACKGROUND OF THE INVENTION

1. Field of the Invention

The present invention relates to a lens manufacturing method, a lens, and a lens holding device, and particularly, to a lens manufacturing method for grinding and polishing a lens, a lens manufactured through grinding and polishing, and a lens holding device used for manufacturing such a lens.

2. Description of the Related Art

When objects to be machined, such as lenses or semiconductor wafers, are grinded and polished, an object to be machined is fixed by bonding a reverse surface of the object to be machined to a holding fixture (jig) or suctioning the reverse surface of the object to be machined via the holding fixture, and a surface to be machined is machined using a machining machine in the fixed state.

For example, JP2000-79547A describes that an adhesive is used or a reverse surface is suctioned when a lens is attached to a jig for lens polishing. Additionally, JP2002-126960A describes that a lens is suctioned by a number of suction ports when a lens is polished, and JP1996-323571A (JP-H08-323571A) and JP2005-118979A describe that a planar semiconductor wafer is suctioned via a porous body or a number of holes.

Additionally, it is known that, when an object to be machined with a generally non-planar shape such as a lens is fixed to the holding fixture, the shape of a holding surface of the holding fixture imitates the shape of a reverse surface of the object to be machined. For example, JP2003-334748A describes that a lens reverse surface is fixed to a fixture via a low melting alloy, and JP2013-180372A and JP2013-180373A describe that a lens holding member having plasticity or shape memory properties is deformed according to the shape of a reverse surface of a lens.

SUMMARY OF THE INVENTION

In recent years, making an image finer is advancing in movies, television broadcasting, or the like. Along with this, sensors that capture such a high-definition image are also made to increase the number of pixels, and pixel size becomes small. For this reason, the accuracy required of an optical system is also made very high. For example, in ordinary spherical lenses, a saddle-type error (a so-called astigmatism error) may be generated in a planar shape, and aberration is generated in a transmission wave surface due to a difference in surface shape accuracy from a reverse surface. It is expected from now on that an allowable value of this astigmatism error is 0.1 μm or less.

However, in the above-described related-art techniques, it was difficult to machine non-planar lenses along with both surfaces with high accuracy.

For example, in the technique described in the above JP2000-79547A, simply when positioning being performed by a positioning member, the lens is held and fixed with an error of the reverse surface of the lens being indwelled, and a relative surface shape error occurs on the front and reverse surface of the lens. Additionally, in JP2002-126960A, the lens reverse surface (a surface opposite to the surface to be machined) is a plane, and cannot be applied in a case where the reverse surface and the lens holding surface of the holding fixture are non-planes. Also in JP1996-323571A (JP-H08-323571A) and JP2005-118979A, the object to be machined such as a semiconductor wafer is planar, and cannot be applied in a case where the reverse surface and the lens holding surface of the holding fixture are non-planes. Moreover, in all of JP2003-334748A, JP2013-180372A, and JP2013-180373A, the holding is made in a state where (the holding surface of) the holding fixture has imitated the shape of the reverse surface of the lens (the shape of the holding surface is deformed according to the lens reverse surface, and the shape itself of the reverse surface of the lens does not vary). In a case where an error (surface shape error) is in the lens reverse surface, the holding is made with the error being indwelled. For this reason, in a case where a front surface that is an opposite surface (a surface to be machined) of the lens held in this way is grinded or polished, the surface shape of the surface to be machined (front surface) is machined with the accuracy of the machining machine. Therefore, a relative error occurs on the front and reverse surfaces of the lens detached from the holding fixture. As a result, an optical transmission wave surface will have aberration.

The invention has been made in view of such circumstances, and an object thereof is to provide a lens manufacturing method that can manufacture a lens having excellent optical transmission performance, a lens having excellent optical transmission performance, and a lens holding device used for manufacturing such a lens.

In order to achieve the above object, a lens manufacturing method according to a first aspect of the invention is a lens manufacturing method comprising a holding step of holding a lens in a lens holding fixture, and a machining step of machining a surface to be machined in the held lens. A reverse surface of the surface to be machined is machined into a non-planar shape with a first surface shape error. A lens holding surface of the lens holding fixture is machined into the same shape as the non-planar shape with a second surface shape error smaller than the first surface shape error. In the holding step, the reverse surface is brought into surface contact with the lens holding surface in imitation of the lens holding surface to correct the shape of the lens such that the reverse surface runs along the lens holding surface. In the machining step, the surface to be machined is machined in a state where the correction has been made by the holding step.

According to the first aspect of the invention, by bringing the reverse surface of the lens having the first surface shape error into surface contact with the lens holding surface having the second surface shape error smaller than the first surface shape error in imitation of the lens holding surface, the shape (the front surface and the reverse surface) of the lens is corrected (deformed by a difference between the first surface shape error and the second surface shape error), and the surface to be machined is machined in this corrected state. Accordingly, the surface to be machined (front surface) in the lens is machined with machining accuracy determined depending on a distance between a machining tool and a lens holding surface (or the reverse surface of the held lens) of the lens holding fixture. If the machining is completed and the lens is removed from the holding fixture, the corrected state is completed and the lens reverse surface returns (is deformed) to its original shape (a state having the first surface shape error). However, the surface to be machined is also deformed in the same direction as the reverse surface by the "difference between the first surface shape error and the second surface shape error" due to the completion of the corrected state (in addition, in a case where the second surface shape error is very small compared to the first surface shape error, any one of the surfaces may be considered to be deformed by the first surface shape error). That is, since the same surface shape error (first surface shape error) occurs in the same direction as the thickness direction (a front and reverse surface direction) of the lens on the front surface and the reverse surface, the first surface shape errors are offset from each other on the reverse surface and the front surface of the lens, and a lens thickness error becomes small. As a result, a lens (a lens having excellent optical transmission performance) with a small transmission wave surface aberration can be manufactured.

In addition, in the first aspect and the following respective aspects, the "non-planar shape" may be a spherical shape or may be an aspheric shape. Additionally, as a case where the lens reverse surface and a lens holding surface have "the same shape", for example, cases where both surfaces are spherical surfaces with the same radius, and the same paraboloidal surfaces, elliptical surface, the same hyperboloidal surfaces, and the same high-order polynomial surfaces are included.

In the lens manufacturing method related to a second aspect based on the first aspect, an aligning step of performing alignment of the reverse surface and the lens holding surface is further comprised, and the holding step is performed after the aligning step. The machining error of the lens can be made small by performing the alignment.

In the lens manufacturing method related to a third aspect based on the first or second aspect, in the aligning step, the alignment is performed by placing the reverse surface on an elastic holding member installed at a peripheral edge portion of the lens holding surface. In this aspect, the correction of the lens shape is kept from being influenced by placing the reverse surface on the elastic holding member installed at the peripheral portion of the lens holding surface to perform the alignment.

In the lens manufacturing method related to a fourth aspect based on any one of the first to third aspects, the elastic holding member is installed outside an effective diameter of the reverse surface. Since the elastic holding member is installed outside the effective diameter of the reverse surface, the influence exerted on the correction of the lens shape is made less. In addition, in a fourth aspect, the outside of a diameter to be machined, an outer peripheral portion (peripheral edge portion) held by the holding member at the time of the attachment to a lens barrel, or the like can be "outside the effective diameter".

In the lens manufacturing method related to a fifth aspect based on any one of the first to fourth aspects, in the aligning step, the center of the lens and the center of the lens holding fixture are aligned with each other.

In the lens manufacturing method related to a sixth aspect based on any one of the first to fifth aspects, in the holding step, the correction is performed by suctioning the reverse surface via the lens holding fixture to make the reverse surface imitate the lens holding surface. By suctioning the reverse surface via the holding fixture, the reverse surface is held by the holding fixture in a state where the lens shape is corrected.

In the lens manufacturing method related to a seventh aspect based on any one of the first to sixth aspects, the second surface shape error is ½ or less of an allowable value (for example, a PV value 0.3 μm) of a thickness distribution error of the lens. In addition, in the seventh aspect, it is more preferable that the second surface shape error is ⅕ or less of the allowable value of the thickness distribution error of the lens.

In the lens manufacturing method related to an eighth aspect based on any one of the first to seventh aspects, the first surface shape error and the second surface shape error are specified by a PV value. In addition, the PV value (Peak-to-Valley Value) is a maximum error of a shape with respect to a design value of a machined surface, that is, a difference between a highest point (Peak) and a lowest point (Valley) within a measuring range, and is widely used for expressing the shape accuracy of an optical member.

A lens related to a ninth aspect of the invention is manufactured by the lens manufacturing method according to any one of the first to eighth aspects. Since the lens is manufactured by the lens manufacturing method according to any one of the first to eighth aspects, the surface shape errors are offset from each other on the reverse surface and the front surface of the lens, and a lens thickness error becomes small. As a result, a lens (a lens having excellent optical transmission performance) with a small transmission wave surface aberration is obtained.

In order to achieve the above object, a lens related to a tenth aspect of the invention is a lens having a front surface and a reverse surface machined into a non-planar shape. A surface shape error of the front surface is offset by a surface shape error of the reverse surface. Accordingly, the surface shape errors are offset from each other on the reverse surface and the front surface of the lens, and thereby, the lens thickness error becomes small. As a result, a lens (a lens having excellent optical transmission performance) with a small transmission wave surface aberration is obtained.

In the lens related to an eleventh aspect of the invention based on the tenth aspect, the surface shape error of the front surface and the surface shape error of the reverse surface have the same size, and occur in the same direction as a thickness direction of the lens. In the eleventh aspect, the offset of the surface shape errors in the above tenth aspect is specifically described.

In order to achieve the above object, a lens holding device related to a twelfth aspect of the invention is a lens holding device comprising a lens holding fixture that holds a lens; and a correction unit that corrects the shape of the lens such that a surface to be held in the lens runs along a lens holding surface of the lens holding fixture. The lens holding surface and the surface to be held are machined into the same non-planar shape. A surface shape error of the lens holding surface is smaller than a surface shape error of the surface to be held. The correction unit brings the surface to be held into surface contact with the lens holding surface in imitation of the lens holding surface to perform correction. The twelfth aspect specifies the invention of the lens holding device corresponding to the lens manufacturing method related to the first aspect, and a lens (a lens having excellent optical transmission performance) with small transmission wave surface aberration can be manufactured by using this lens holding device.

In the lens manufacturing device related to a thirteenth aspect based on the twelfth aspect, the surface shape error of the lens holding surface and the surface shape error of the surface to be held are specified by a PV value. The meaning of the PV value is the same as the above-described one of the eighth aspect.

According to the lens manufacturing method, the lens, and the lens holding device of the invention, a lens having excellent optical transmission performance can be obtained.

BRIEF DESCRIPTION OF THE DRAWINGS

FIG. 2A is a plan view, FIG. 2B is a cross sectional view, and FIGS. 2C, and 2D are partial sectional views.

FIG. 5A is a perspective view, and FIG. 5B is a plan view.

FIG. 9 is a table illustrating machining conditions and machining results according to the example and comparative examples of the lens machining according to the invention.

FIG. 12A is a plan view, and FIG. 12B is a cross sectional view.

DESCRIPTION OF THE PREFERRED EMBODIMENTS

Hereinafter, embodiments of a lens manufacturing method, a lens, and a lens holding device related to the invention will be described with respect to the accompanying drawings.

<Configuration of Lens Manufacturing Apparatus>

Figure 1:
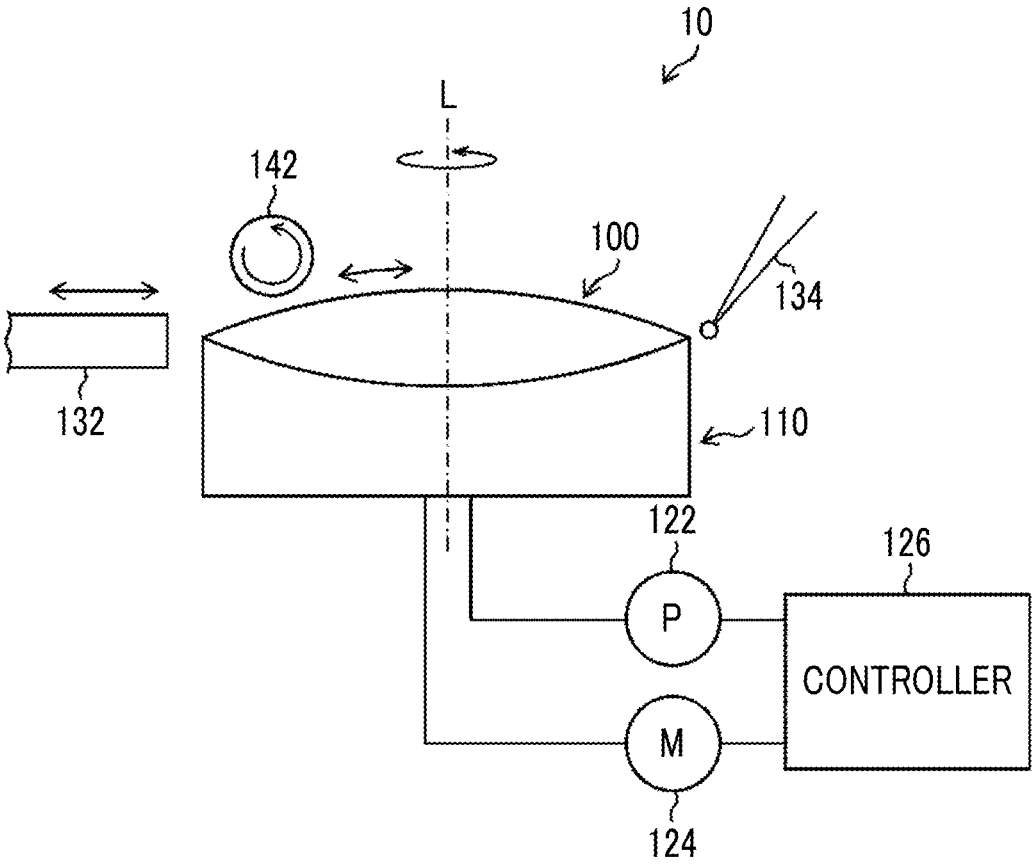
FIG. 1 is an external view illustrating a lens manufacturing apparatus related to an embodiment of the invention.

FIG. 1 is a view illustrating the configuration of main parts of a lens manufacturing apparatus 10 (including the lens holding device) to which an embodiment of the invention is applied. The lens manufacturing apparatus 10 is constituted by a lens holding fixture (holding fixture) 110, a pump 122 (correction unit), a motor 124, a controller 126 (correction unit), a push-out tool 132, a measurement pick 134, and a grindstone 142, and a power supply device (not illustrated) in addition to these.

The lens holding fixture 110 suctions and holds a lens 100 via the pump 122 and is rotated about an axis L by the motor 124. Control for the suction, the holding, and the rotation is performed by the controller 126. The push-out tool 132 is configured to be movable forward and backward in a direction passing through the center of the lens holding fixture 110, and is adapted to be able to push a side surface of the lens 100 placed on the lens holding fixture 110. The measurement pick 134 is adapted to be disposed outside the lens 100 and the lens holding fixture 110 and be able to detect any contact with the lens 100, and the alignment between the lens 100 and the lens holding fixture 110 is performed by the push-out tool 132 and the measurement pick 134.

The details of lens machining using the lens manufacturing apparatus 10 will be described below.

<Configuration of Lens Holding Fixture>

Figure 2A:
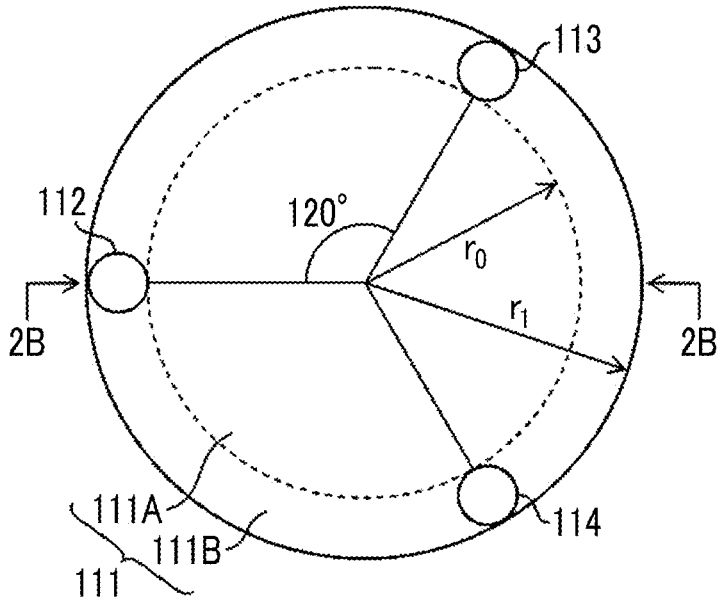
FIGS. 2A to 2D illustrate a lens holding fixture related to the embodiment of the invention.
Figure 2B:
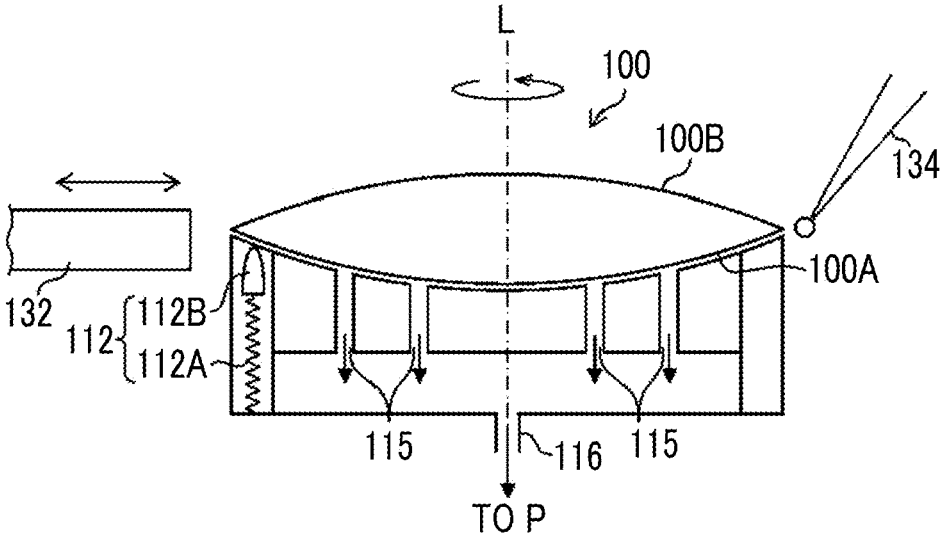

FIGS. 2A to 2D are views illustrating the configuration of the lens holding fixture 110, FIG. 2A is a plan view, FIG. 2B is a cross sectional view in a direction 2B-2B of FIG. 2A.

<Elastic Holding Member>

As illustrated in FIG. 2A, a lens holding surface 111 of the lens holding fixture 110 is divided into a region 111A that is a center portion and a region 111B that is a peripheral edge portion. The region 111A is a region corresponding to the effective diameter (diameter $r_0$) of a reverse surface 100A of the lens 100, and the region 111B (diameter $r_1>r_0$) is a region outside the effective diameter of the reverse surface 100A. Here, the effective diameter is the diameter of parallel pencil of rays that exit from infinity object point on the optical axis of a lens and pass through the lens. In the region 111B, the elastic holding members 112, 113, and 114 are disposed so as to form an angle of 120° mutually with respect to a center O of the lens holding surface 111.

Figure 2C:
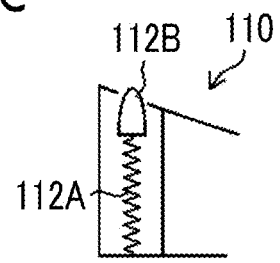
Figure 2D:
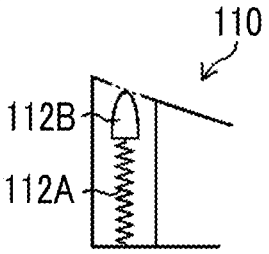

The elastic holding member 112 consists of a spring 112A and a head 112B, and the head 112B protrudes to an upper part of the region 111B, as illustrated in FIG. 2C, in a state where the suction of the lens 100 is not performed. Then, if the lens 100 is suctioned as will be described below, as illustrated in FIG. 2D, the spring 112A is pushed and compressed by the reverse surface 100A of the lens 100, and an upper end of the head 112B is located on the surface of the region 111B. Then, if the suction of the lens 100 is completed and the lens 100 is detached from the lens holding fixture 110, the elastic holding member 112 is returned back to a state as illustrated in FIG. 2C by the elastic force of the spring 112A.

Since the structure and working of the elastic holding members 113 and 114 are the same as those of the elastic holding member 112, the description thereof will be omitted.

<Hole and Suction Port>

The lens holding fixture 110 is provided with a plurality of holes 115 passing therethrough in a vertical direction from the lens holding surface 111. The holes 115 communicate with a suction port 116 in a lower part of the lens holding fixture 110, and suction the reverse surface 100A of the lens 100 via the holes 115 and the suction port 116 during lens holding.

<Procedure of Lens Machining>

Figure 3:
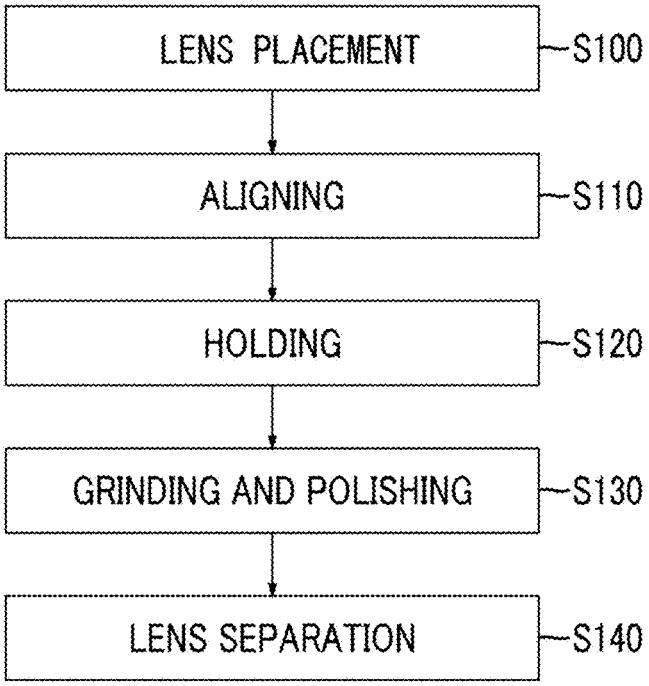
FIG. 3 is a flowchart illustrating a lens manufacturing method related to the embodiment of the invention.
Figure 4:
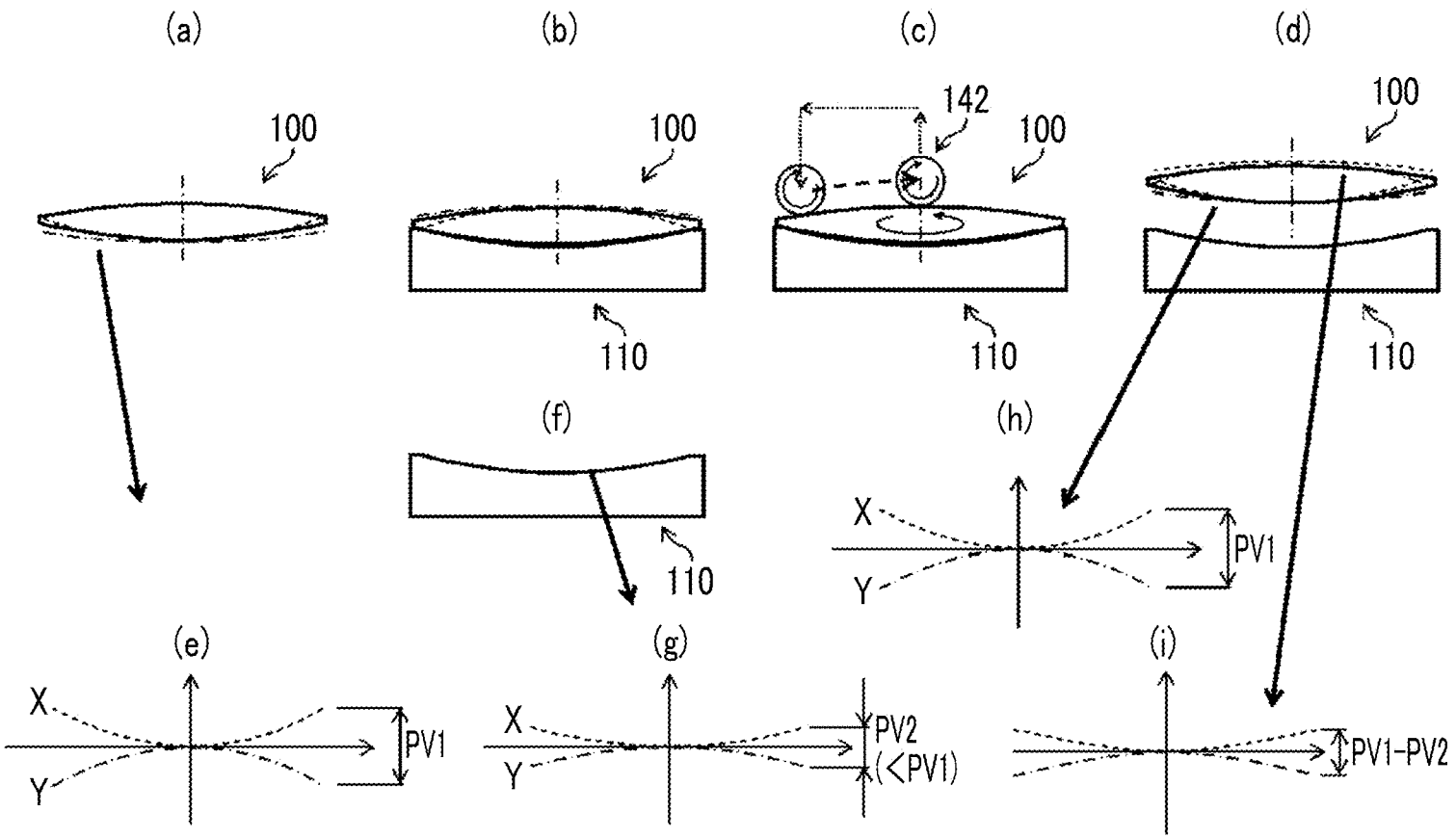
FIG. 4 is a view illustrating an aspect of the lens manufacturing method related to the embodiment of the invention.
Figure 5A:
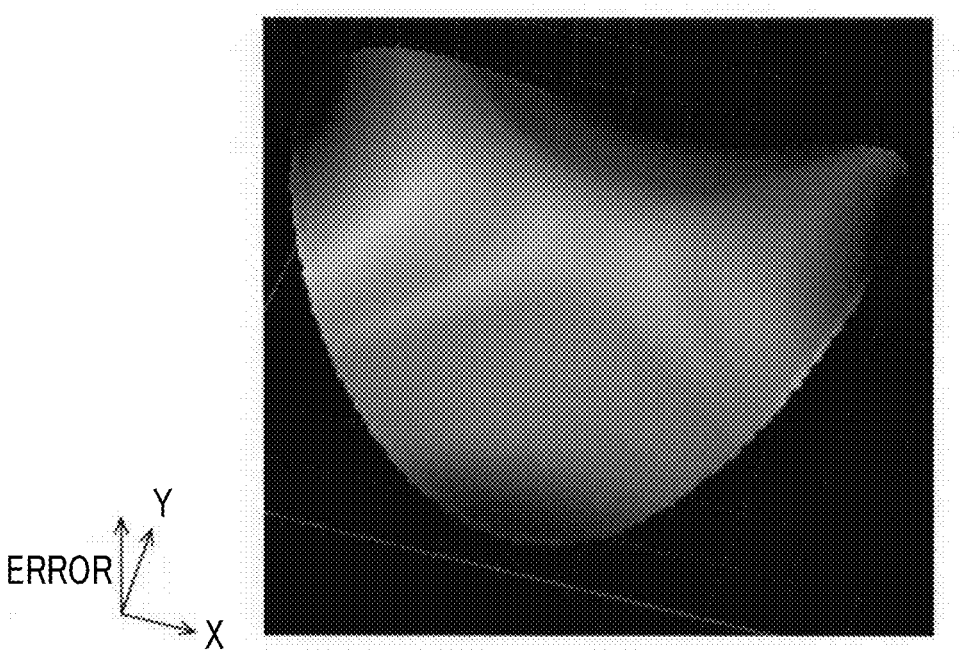
FIGS. 5A and 5B are views illustrating an example of an astigmatism error.
Figure 5B:
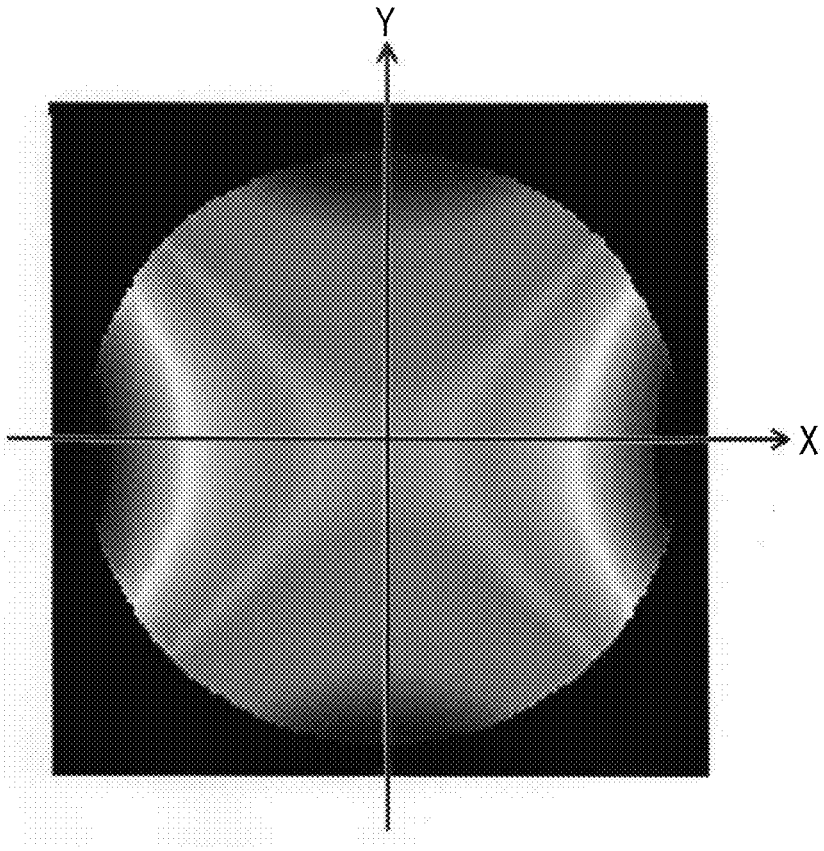

Next, a lens manufacturing method using the lens manufacturing apparatus 10 related to the present embodiment will be described. FIG. 3 is a flowchart illustrating a procedure of such a lens manufacturing method (lens machining method), and FIG. 4 is a conceptual diagram illustrating an aspect of a lens error during the lens machining. Additionally, FIGS. 5A and 5B are views illustrating an example of an astigmatism error. In addition, in FIG. 4 and its subsequent drawings, dotted lines represents errors in an X-axis direction, and one-dot chain lines represents errors in a Y-axis direction.

First, the lens 100 is placed on the lens holding fixture 110 (S100). In this state, the reverse surface 100A is machined in a spherical shape (non-planar shape) with a radius R, and has an astigmatism error PV1 (first surface shape error) as illustrated in FIG. 4(*a*) and FIG. 4(*e*). The "astigmatism" is a word having "astigmatism" as the origin of a word, and the "astigmatism error" generally means an unsymmetrical surface shape error in machining of an optical member. For example, as illustrated in FIGS. 5A and 5B, in a case where the astigmatism error has a surface shape error (a difference between a design value and an actual shape) that is convex downward in the X direction and is convex upward in the Y direction, it can be said to "have an astigmatism error". This astigmatism error is expressed by a PV value (Peak-to-Valley Value), that is, a maximum error (a difference between a highest point (Peak) and a lowest point (Valley) within a measuring range) with respect to a design value of a machined surface (here, the reverse surface 100A). In the present embodiment, it is assumed that the reverse surface 100A has the astigmatism error PV1 as illustrated in FIG. 4(*e*).

The above-described aspheric surface shape and astigmatism error shape can be expressed by the following Equation.

<Aspheric Surface Shape Definitional Equation (Rotation Object with Respect to Optical Axis)>

[Equation 1]

$$Z = \frac{Ch^2}{1+\sqrt{1-(1+K)\times C^2h^2}} + A4\times h^2 + A6\times h^3 + A8\times h^4 \ldots + A20\times h^{10} \quad (1)$$

<Astigmatism Shape Definitional Equation>

[Equation 2]

$$Z = \frac{\frac{x^2}{Rx}+\frac{y^2}{Ry}}{1+\sqrt{1-(1+K)\times\left(\frac{x^2}{Rx^2}+\frac{y^2}{Ry^2}\right)}} + A4\times((1-A4)\times x^2+(1+A4)\times y^2)^2 + A6\times((1-A6)\times x^2+(1+A6)\times y^2)^3 + A8\times((1-A8)\times x^2+(1+A8)\times y^2)^4 + \vdots \; A20\times((1-A20)\times x^2+(1+A20)\times y^2)^{10} \quad (2)$$

Here, C is an inverse number of the paraxial curvature radius of a lens, h is the height from the optical axis, K is a cone constant, and A4 to A20 are aspheric surface coefficients. In the case of a spherical surface, K=0 and A4 to A20=0.

In addition, as illustrated in FIGS. 4(*f*) and 4(*g*), the lens holding surface (holding surface) 111 of the lens holding fixture 110 is machined in a spherical shape (non-planar shape) with the radius R at an astigmatism error PV2 (<PV1; second surface shape error) (that is, the lens holding surface 111 is machined into the same shape as the reverse surface 100A at the astigmatism error PV2 smaller than the astigmatism error PV1 of the reverse surface 100A of the lens 100).

In addition, in S100, as described above, the reverse surface 100A of the lens 100 is held to abuts against the elastic holding members 112, 113, and 114 (refer to FIGS. 2B and 2C).

Next, alignment (aligning step) of the lens 100 and the lens holding fixture 110 is performed (S110). This alignment is performed by pushing the side surface (end part) of the lens 100 with the push-out tool 132 as described above, and it can be seen that, if a suitable amount of push-out is reached, an opposite side surface of the lens 100 touches the measurement pick 134, the measurement pick 134 fluctuates, a signal showing the fluctuation is output, and the amount of push-out becomes suitable. In a case where the amount of push-out is excessive, the lens holding fixture 110 has only to be half-rotated by the motor 124 and the controller 126 to push out the opposite side surface. By repeating the push-out in this way while the lens holding fixture 110 is rotated appropriately, the alignment can be performed, and the center of the lens 100 and the center of the lens holding fixture 110 can be matched with each other.

If the alignment is performed in S110, the lens 100 is held by the lens holding fixture 110 in an aligned state (S120; holding step). The holding of the lens 100 is performed by suctioning the reverse surface 100A of the lens 100 via the holes 115 and the suction port 116 using the pump 122 and the controller 126, as described above. Then, by suctioning the reverse surface 100A in this way, the shape of the reverse surface 100A comes into surface contact with the lens holding surface 111 of the lens holding fixture 110 in imitation of the lens holding surface 111. Accordingly, the shape of the lens 100 is corrected (deformed) such that the reverse surface 100A having the astigmatism error PV1 runs along the lens holding surface 111 having the astigmatism error PV2 (<PV1) (refer to FIG. 4(*b*)). That is, the reverse surface 100A is deformed by a difference between the astigmatism error PV1 and the astigmatism error PV2.

Such holding continues being performed until the machining (grinding and polishing) of the lens 100 is completed.

If the lens 100 is held, grinding and polishing is performed (S130; machining step). This grinding and polishing is performed by moving a front surface 100B (surface to be machined) of the lens 100, rotating the grindstone 142 using a motor (not illustrated) as illustrated in FIG. 4(*c*) while the lens holding fixture 110 is rotated by the motor 124 and the controller 126. In addition, since the lens holding fixture 110 is rotating, it is not necessary to perform grinding and polishing from an outer peripheral part of the front surface 100B to an opposite outer peripheral part, and grinding and polishing has only to be repeated from one outer peripheral part to the center (or from the center to the outer peripheral part). The front surface 100B is machined with machining accuracy depending on the distance accuracy between the grindstone 142 and the lens holding surface 111 (or held reverse surface 100A) of the lens holding fixture 110 by such grinding and polishing.

After the grinding and polishing of S130 is completed, the rotation of the lens holding fixture 110 is stopped, suction of the reverse surface 100A is stopped and the lens 100 is separated from the lens holding fixture 110 (S140). Then, as illustrated in FIG. 4(*d*) and FIG. 4(*h*), during the suctioning and holding, the reverse surface 100A that has imitated the lens holding surface 111 returns to its original shape, and has the astigmatism error PV1 (PV value). However, simultaneously with this, the front surface 100B is also deformed in the same direction as the reverse surface 100A and is deformed by the "difference between the astigmatism error PV1 and the astigmatism error PV2" (refer to FIG. 4(*i*)). Hence, since the same astigmatism errors (surface shape errors) PV1 occur in the same direction with respect to a thickness direction (a front and reverse surface direction) of a lens on the reverse surface 100A and the front surface 100B, the astigmatism errors PV1 are offset from each other on the reverse surface 100A and the front surface 100B.

As described above, according to the lens manufacturing apparatus 10, the lens holding fixture 110, and the lens manufacturing method related to the present embodiment, a lens 100 with a small surface shape error and a small transmission wave surface aberration (a lens having excellent optical transmission performance) can be obtained.

EXAMPLE AND COMPARATIVE EXAMPLES

Next, the lens manufacturing apparatus 10, the lens 100, the lens holding fixture 110, and the lens manufacturing method related to the above embodiment will be described, showing specific numerical values using an example and comparative examples. The conditions of the example and Comparative Examples 1 and 2 are as follows.

Example

Surface shape error of lens reverse surface (astigmatism error: PV value): 150 nm Surface shape error of lens holding fixture (astigmatism error: PV value): 30 nm

Comparative Example 1

Surface shape error of lens reverse surface (astigmatism error: PV value): 50 nm Surface shape error of lens holding fixture (astigmatism error: PV value): 200 nm

Comparative Example 2

Surface shape error of lens reverse surface (astigmatism error: PV value): 180 nm Surface shape error of lens holding fixture (astigmatism error: PV value): 30 nm The above example is an example in a case where (Surface shape error of lens reverse surface<Surface shape error of lens holding fixture) is satisfied, that is, the reverse surface error is corrected by the holding fixture, that is, the conditions of the invention are satisfied, and Comparative example 1 is an example in a case where (Surface shape error of lens reverse surface>Surface shape error of lens holding fixture) is satisfied, that is, the conditions of the invention are not satisfied. Additionally, Comparative Example 2 is a case where (Surface shape error of lens reverse surface<Surface shape error of lens holding fixture) is satisfied but the surface shape error of the lens reverse surface is not corrected by the lens holding fixture (for example, a case according to a related-art holding method such that a lens is bonded at an outer peripheral part of the lens by the lens holding fixture).

Figure 6:
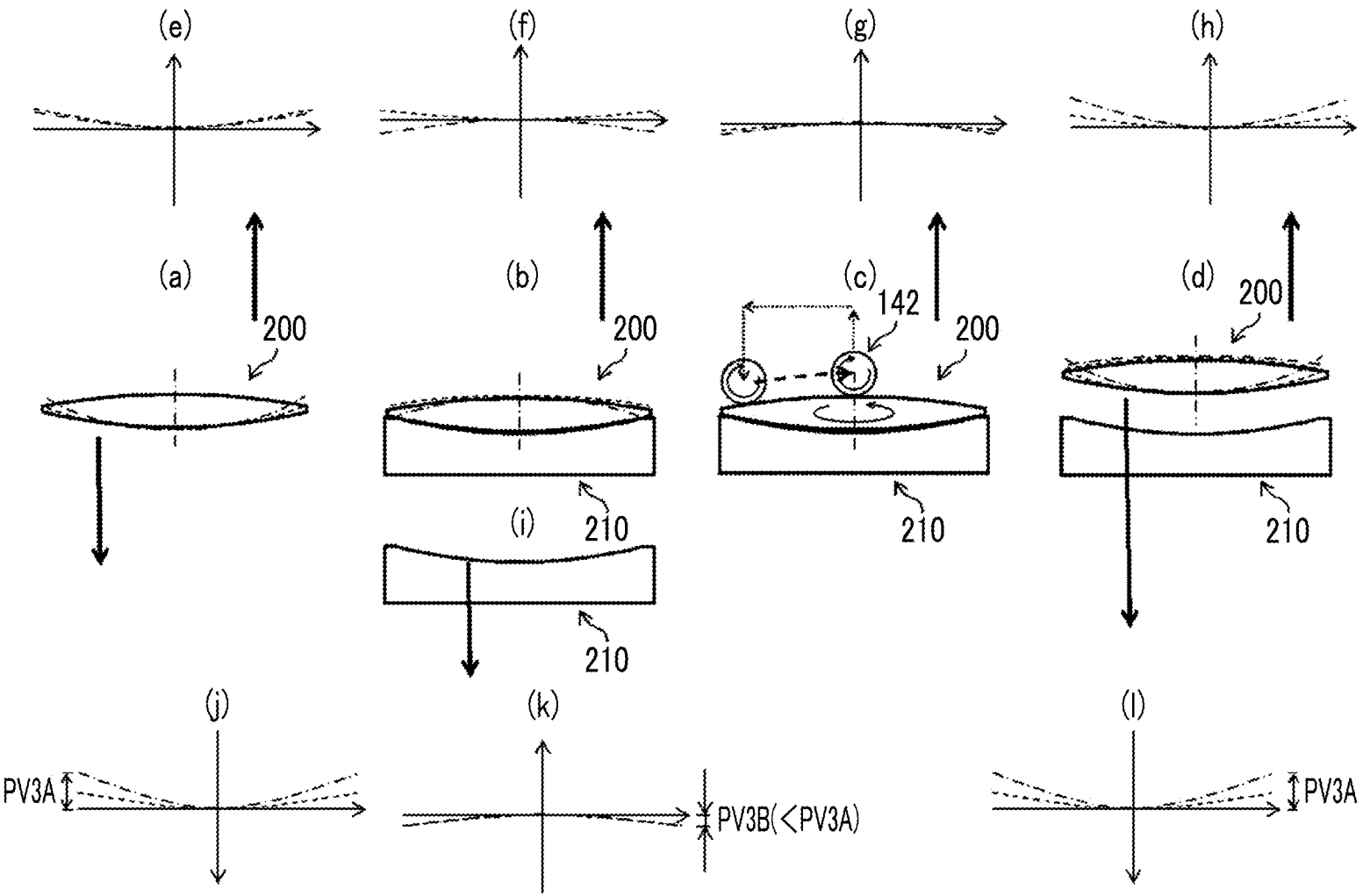
FIG. 6 is a view illustrating an aspect of lens machining according to one example of the invention.

FIG. 6 is a view illustrating an aspect of the lens machining in the above example and an error in that case. A reverse surface of a lens 200 related to the present example, has an astigmatism error PV3A (refer to FIG. 6(*a*) and FIG. 6(*j*)), and a lens holding surface of a lens holding fixture 210 has an astigmatism error PV3B (refer to FIG. 6(*i*) and FIG. 6(*k*)). If the lens 200 is suctioned and held by the lens holding fixture 210 (refer to FIG. 6(*b*)), the shape of the lens 200 is corrected by the lens holding fixture 210, and is deformed as illustrated in FIG. 6(*f*). Then, if the surface of the lens 200 is machined (grinded, polished) as illustrated in FIG. 6(*c*), a front surface of the lens 200 is brought into a state where this front surface has a machining error as illustrated in FIG. 6(*g*). Then, if the machining is completed and the lens 200 is separated from the lens holding fixture 210 (refer to FIG. 6(*d*)), the reverse surface of the lens 200 returns to a state having the astigmatism error PV3A similar to before the suctioning and the holding (refer to FIG. 6(*l*)), and a state where this astigmatism error PV3A is also added to the front surface of the lens 200 is brought about.

Hence, astigmatism errors PV3A are offset from each other at the front surface and the reverse surface of the lens 200 similar to the above-described embodiment by the above machining. In addition, FIG. 6(*e*), FIG. 6(*f*), FIG. 6(*g*), and FIG. 6(*h*) respectively illustrate a state where the front surface of the lens 200 has an initial error, a state where the front surface is deformed due to the suctioning and holding and the error also has varied, a state where the front surface has an error caused by machining, and a state where the astigmatism error PV3A is added to the machining error.

Figure 7:
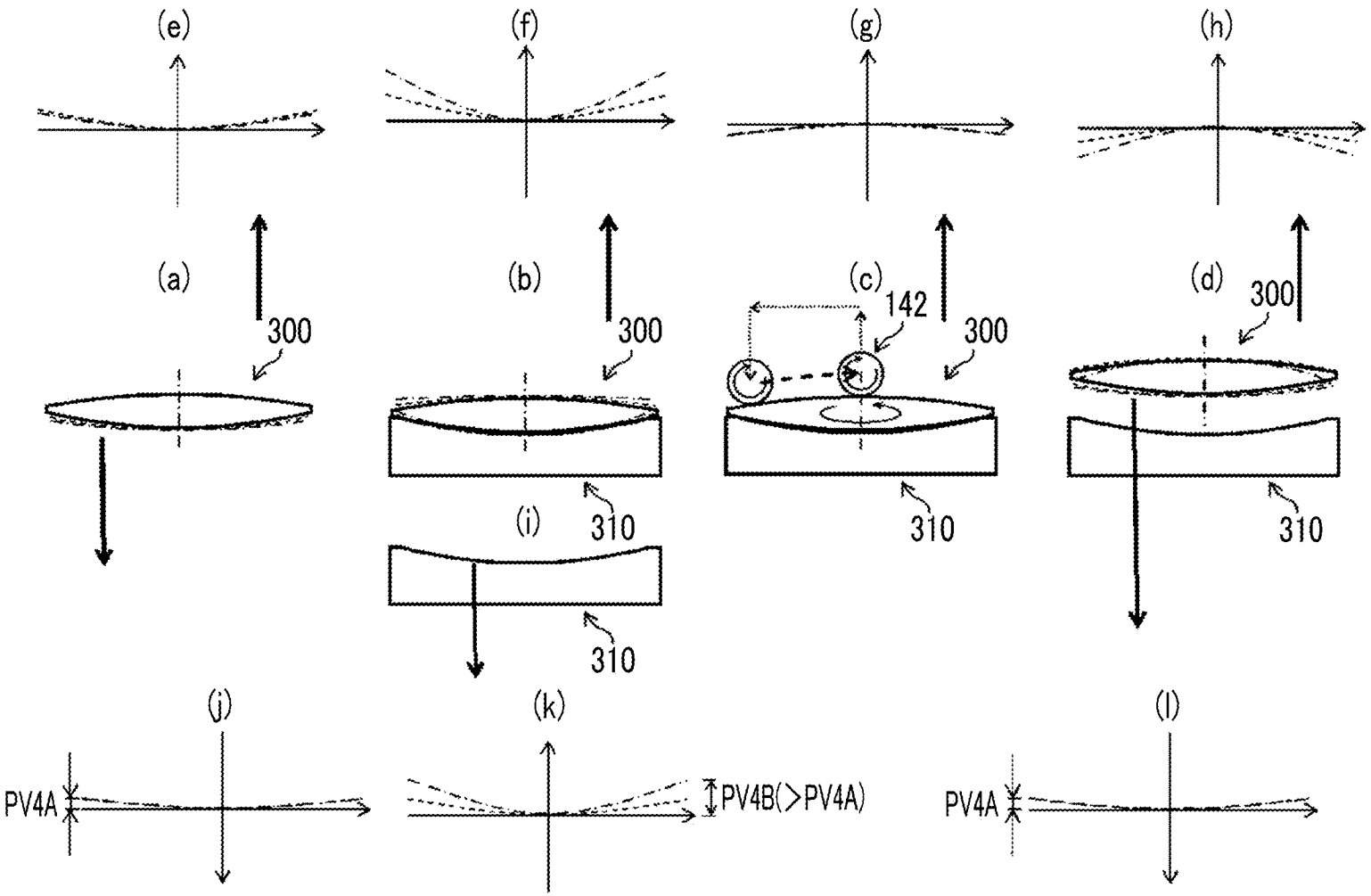
FIG. 7 is a view illustrating an aspect of a comparative example of the lens machining.

FIG. 7 is a view illustrating a machining state in the above Comparative Example 1. In Comparative Example 1, a lens 300 is machined using a lens holding fixture 310, and finally, astigmatism errors PV4A are offset from each other at a front surface and a reverse surface of the lens 300. Since meanings of FIG. 7(*a*) to FIG. 7(*l*) are the same as those of FIG. 6(*a*) to FIG. 6(*l*), the detailed description thereof will be omitted.

Figure 8:
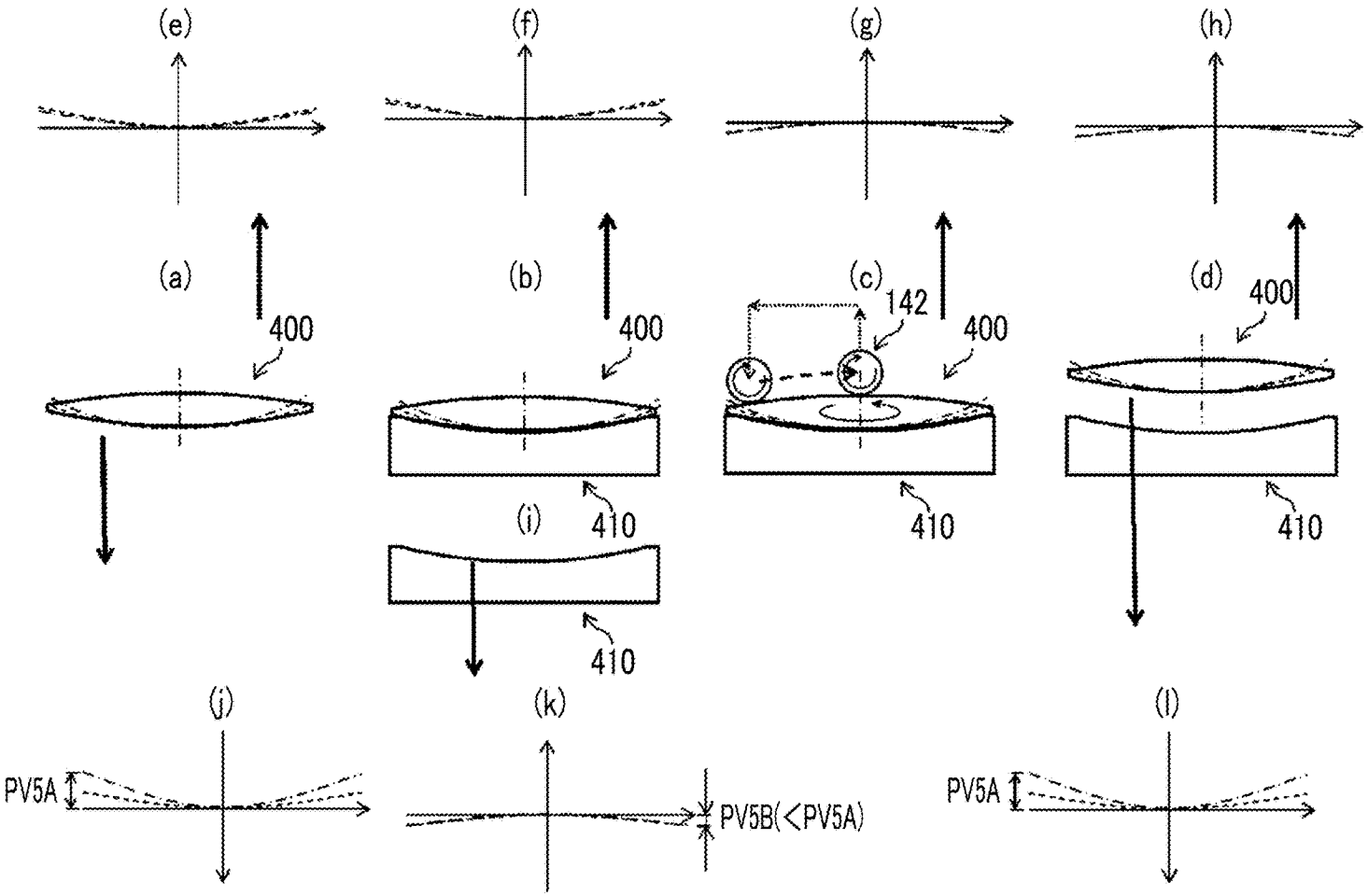
FIG. 8 is a view illustrating an aspect of another comparative examples of the lens machining.

FIG. 8 is a view illustrating a machining state in the above Comparative Example 2. In Comparative Example 2, a lens 400 is machined using a lens holding fixture 410. The astigmatism error of the reverse surface of the lens 400 is PVSA, and the error of the lens holding fixture 410 is PV5B (<PV5A). Since meanings of FIG. 8(*a*) to FIG. 8(*l*) are the same as those of FIG. 6(*a*) to FIG. 6(*l*), the detailed description thereof will be omitted.

FIG. 9 illustrates a table obtained when the machining results of the above example and Comparative Examples 1 and 2 are summarized. As illustrated in FIG. 9, in the example in which the surface shape error of the lens holding fixture is smaller than the astigmatism error of the lens reverse surface and the lens reverse surface is corrected by the lens holding fixture, the transmission wave surface aberration is as small as 25 nm. However, in Comparative Example 1 in which the surface shape error of the lens holding fixture is larger than the astigmatism error on the lens reverse surface and the transmission wave surface aberration is 190 nm and has a larger value as compared to the example. Additionally, in Comparative Example 2 in which the surface shape error of the lens holding fixture is smaller than the astigmatism error of the lens reverse surface and the lens reverse surface is not corrected by the lens holding fixture, astigmatism errors PV5A are not offset from each other at the front surface and the reverse surface of the lens 400, and the transmission wave surface aberration has a larger value (140 nm) as compared to the example.

In this way, according to the invention, it can be seen that a lens with a small transmission wave surface aberration (a lens having excellent optical transmission performance) can be obtained.

<Simulation Result>

Figure 10:
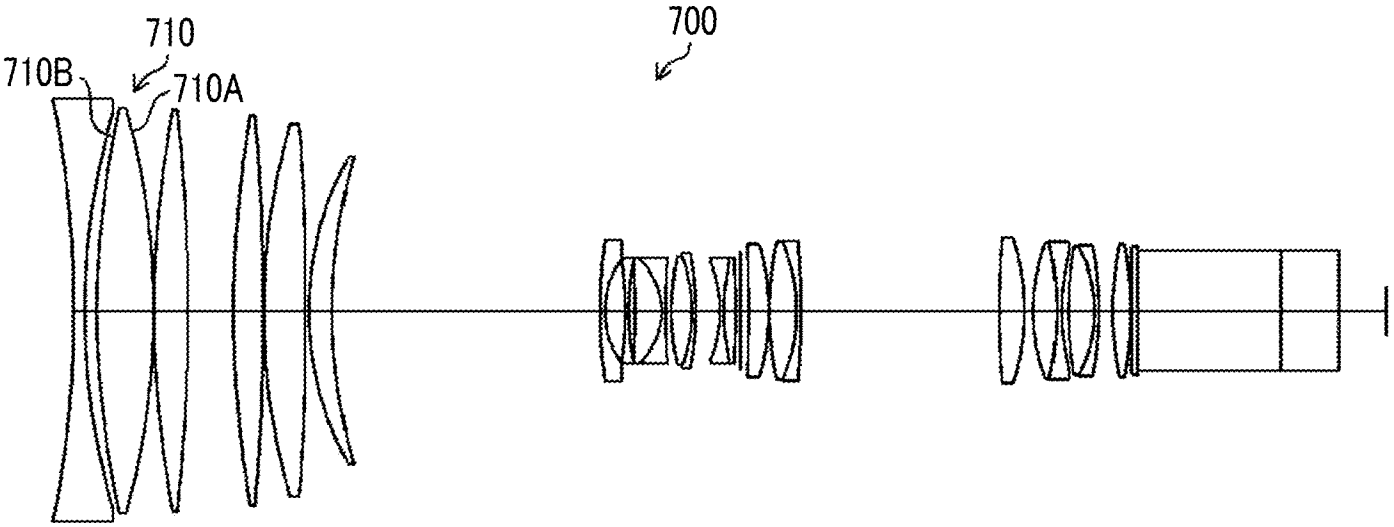
FIG. 10 is a cross sectional view illustrating the configuration of a television lens, and a lens to be machined in the television lens.

Next, results obtained when the lens manufacturing method of the invention is simulated are illustrated. FIG. 10 is a cross sectional view illustrating the configuration of a television lens 700, and a second lens 710 that is an object to be machined. In the present simulation, in a case where there is an astigmatism error in a reverse surface 710A (a fourth surface when a left surface of a first lens is a first surface; a spherical shape) of the second lens 710 in FIG. 10, influences on lens performance in cases where a front surface 710B is polished by a related-art lens manufacturing method (polishing method) and the lens manufacturing method of the invention are compared with each other using wave aberrations.

Figure 11A:
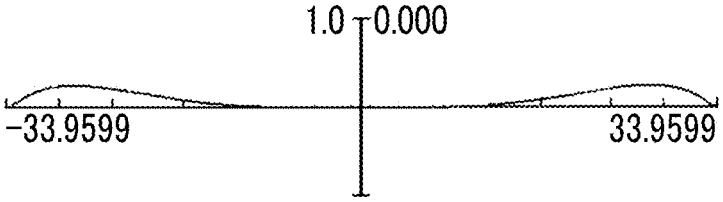
FIGS. 11A to 11E are views illustrating results obtained when wave aberrations of the lens to be machined illustrated in FIG. 10 are simulated.

FIGS. 11A to 11E are views illustrating simulation results of imaging performance on an optical axis when using the lens of FIG. 10. In FIGS. 11A to FIG. 11E, a horizontal axis represents entrance pupil diameter (unit: mm) calculated by "Focal distance/f number", and a vertical axis represents the size (a reference wavelength 1.0λ; here, showing the wavelength of an e line (a spectral line of mercury with a wavelength of about 546 nm)) of wave aberration. FIG. 11A illustrates design values and wave aberrations occur in a positive (+) direction at a lens peripheral portion. In the design values, the wave aberrations are the same (symmetrical) irrespective of direction.

Figure 11B:
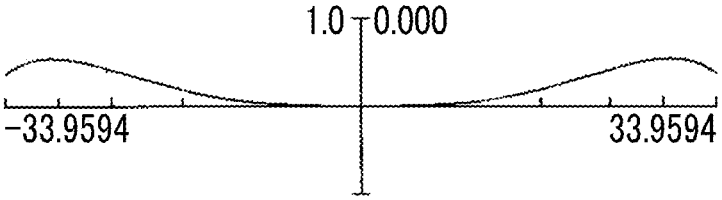
Figure 11C:
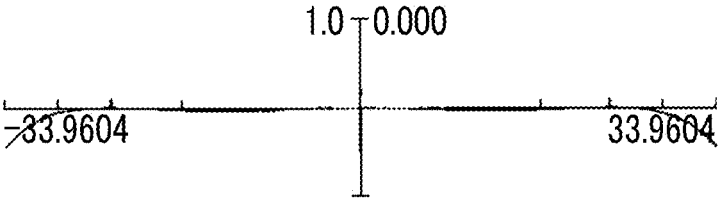

FIGS. 11B and 11C illustrate results obtained by the related-art polishing method. In the case of the related-art polishing method, the front surface 710B and the reverse surface 710A are machined independently. Therefore, the machining error of the reverse surface 710A remains even in a case where the front surface 710B is machined according to design values. FIG. 11B illustrates wave aberrations in a case where +3 shape errors are given in the X direction of the reverse surface 710A, and larger wave aberrations than the design values occur in the positive (+) direction at the lens peripheral portion. On the other hand, FIG. 11C illustrates wave aberrations in a case where −3 shape errors are given in the Y direction of the reverse surface 710A, and wave aberrations occur in a negative (+) direction at the lens peripheral portion. That is, in the related-art polishing method, it can be seen that the astigmatism error of the reverse surface 710A is generated on sides of an image surface that are different from each other in the X direction and in the Y direction, and the lens performance (wave aberrations) is affected.

Figure 11D:
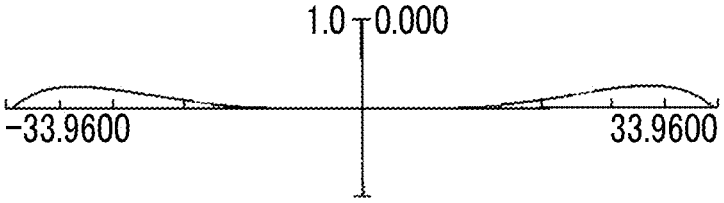
Figure 11E:
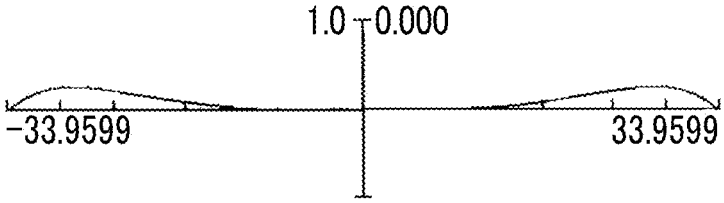

In contrast, in the case of the manufacturing method of the invention, the machining error of the reverse surface 710A is generated as a machining error of the front surface 710B as it is. In FIGS. 11D and 11E, the manufacturing method of the invention is applied, and the machining error of the reverse surface 710A and the machining error of the front surface 710B become an equal amount. That is, wave aberrations in a case where +3 shape errors are given to the reverse surface 710A and the front surface 710B in the X direction, respectively, and similarly −3 shape errors are given thereto in the Y direction are illustrated. Although the wave aberrations occur in the positive (+) direction at the lens peripheral portions of both the front and reverse surfaces, the aberrations are symmetrical in the X direction and in the Y direction, do not have a difference in size, either, and are as being designed. That is, according to the invention, it can be seen that even an astigmatism error in the reverse surface 710A is offset by that in the front surface 710B and the lens performance (wave aberrations) is not influenced. In addition, as for the signs of the above machining error, a case where a surface shape is deformed to an image side with respect to design values is defined as the positive, and a case where the surface shape is deformed to an object side is defined as the negative.

<Other Forms of Lens Holding Fixture>

Next, other forms of the lens holding fixture will be described. In the above-described embodiment and example, an aspect in which the lens holding fixture 110 includes the elastic holding member 112 and the same aspect as this have been described. However, the lens holding fixture in the invention is not limited to such aspects. In addition to the above aspects, an aspect like a lens holding fixture 510 illustrated in FIGS. 12A to 12D is also possible.

Figure 12A:
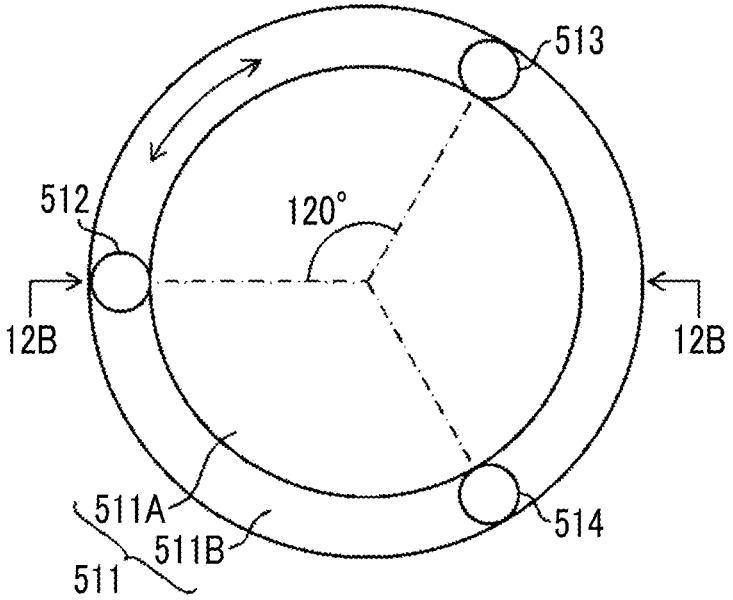
FIGS. 12A and 12B are view illustrating another aspect of the lens holding fixture.

As illustrated in a plan view of FIG. 12A, in the lens holding fixture 510, a main body 511 of a holding part consists of a region 511A that is a center portion, and a region 511B that is a peripheral edge, and the region 511A and the region 511B are constituted as independent members. Elastic holding members 512, 513, and 514 are provided in the region 511B so as to be apart at 120° in the circumferential direction. Although the elastic holding member 512 has a spring 512A and a head 512B similar to the above-described elastic holding member 112, the elastic holding member 512 further includes a bearing 512C, and the region 511B rotates smoothly with respect to the region 511A by this bearing 512C and bearings that the other elastic holding members 513 and 514 include.

Figure 12B:
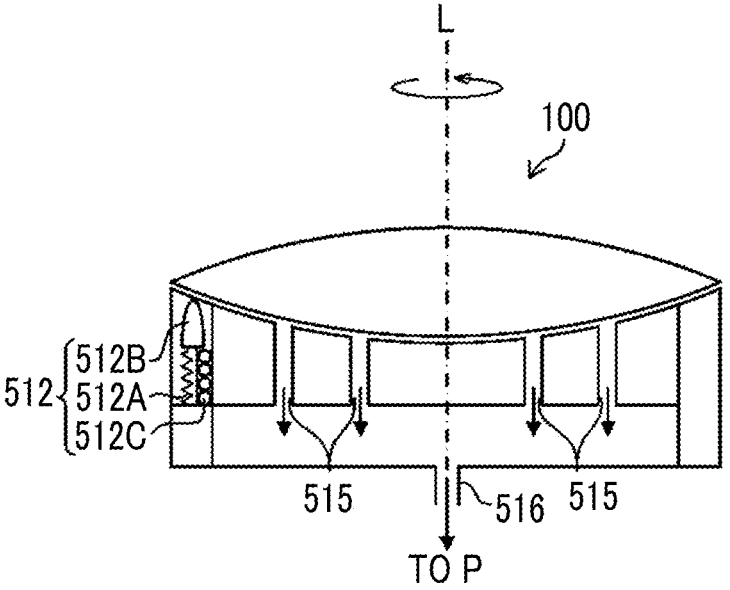

In addition, as illustrated in a cross sectional view (a cross section taken along line 12B-12B of FIG. 12A) of FIG. 12B, the lens holding fixture 510 includes a plurality of holes 515 and a suction port 516, similar to the lens holding fixture 110, and accordingly, is able to perform suction and hold the lens 100.

In the lens holding fixture 510 and the above-described lens holding fixture 110, the elastic holding members are provided in three places apart at equal intervals in the circumferential direction. However, the number and arrangement of elastic holding members are not limited to such an aspect. For example, six or more elastic holding members may be provided at equal intervals in the circumferential direction. Otherwise, not elastic holding members that perform holding substantially at one point but elastic holding members having a length in the circumferential direction or an elastic holding member covering the entire circumference of the lens holding fixture may be provided.

Figure 13:
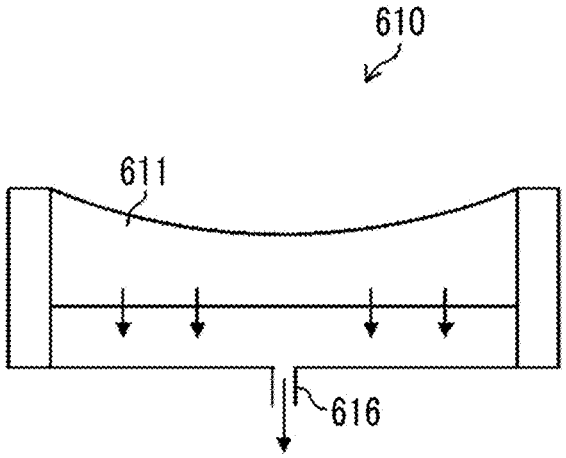
FIG. 13 is a view illustrating still another aspect of the lens holding fixture.

Additionally, in the lens holding fixture 510 and the lens holding fixture 110, the suctioning and holding of a lens is performed by the holes and the suction port. However, as in a lens holding fixture 610 illustrated in FIG. 13, an entire holding portion 611 may be constituted with a porous member, and suctioning and holding may be performed via a suction port 616 provided in a bottom part.

In addition, since elements, such as a pump, a motor, a controller, a push-out tool, and a measurement pick, in FIGS. 12A to 12D and FIG. 13 are the same as those illustrated in FIG. 1 and FIGS. 2A to 2D, the illustration and description thereof will be omitted.

Moreover, it is obvious that the invention is not limited to the above-described embodiment, and various modifications can be made without departing from the spirit of the invention.

EXPLANATION OF REFERENCES

10: lens manufacturing apparatus
100, 200, 300, 400: lens
110, 210, 310, 410, 510, 610: lens holding fixture
111: lens holding surface
112, 113, 114, 512, 513, 514: elastic holding member
115: hole
116, 616: suction port
122: pump
124: motor
126: controller
132: push-out tool
134: measurement pick
142: grindstone

What is claimed is:

1. A lens manufacturing method comprising:

a holding step of holding a lens in a lens holding fixture; and a machining step of machining a surface to be machined in the held lens, wherein a reverse surface of the surface to be machined is machined into a non-planar shape with a first surface shape error, and a lens holding surface of the lens holding fixture is machined into the same shape as the non-planar shape with a second surface shape error smaller than the first surface shape error, wherein, in the holding step, the reverse surface is brought into surface contact with the lens holding surface in imitation of the lens holding surface to correct the shape of the lens such that the reverse surface runs along the lens holding surface, and wherein, in the machining step, the surface to be machined is machined in a state where the correction has been made by the holding step.

2. The lens manufacturing method according to claim 1, further comprising:

an aligning step of performing alignment of the reverse surface and the lens holding surface, wherein the holding step is performed after the aligning step.

3. The lens manufacturing method according to claim 2, wherein, in the aligning step, the alignment is performed by placing the reverse surface on an elastic holding member installed at a peripheral edge portion of the lens holding surface.

4. The lens manufacturing method according to claim 3, wherein the elastic holding member is installed outside an effective diameter of the reverse surface.

5. The lens manufacturing method according to claim 2, wherein, in the aligning step, the center of the lens and the center of the lens holding fixture are aligned with each other.

6. The lens manufacturing method according to claim 1, wherein, in the holding step, the correction is performed by suctioning the reverse surface via the lens holding fixture to make the reverse surface imitate the lens holding surface.

7. The lens manufacturing method according to claim 1, wherein the second surface shape error is ½ or less of an allowable value of a thickness distribution error of the lens.

8. The lens manufacturing method according to claim 1, wherein the first surface shape error and the second surface shape error are specified by a PV value.

* * * * *